US008915753B2

(12) United States Patent
Holland et al.

(10) Patent No.: US 8,915,753 B2
(45) **Date of Patent: *Dec. 23, 2014**

(54) SIGNAL CONTINUITY CONNECTOR

(71) Applicants: Holland Electronics, LLC, Ventura, CA (US); Ming Feng Chien, Ventura, CA (US)

(72) Inventors: Michael Holland, Santa Barbara, CA (US); Ming Feng Chien, Taipei (TW)

( * ) Notice: Subject to any disclaimer, the term of this patent is extended or adjusted under 35 U.S.C. 154(b) by 137 days.

This patent is subject to a terminal disclaimer.

(21) Appl. No.: 13/709,637

(22) Filed: Dec. 10, 2012

(65) Prior Publication Data

US 2013/0149896 A1 Jun. 13, 2013

Related U.S. Application Data

(60) Provisional application No. 61/569,746, filed on Dec. 12, 2011.

(51) Int. Cl.

| | |
|---|---|
| ***H01R 9/05*** | (2006.01) |
| ***H01R 24/38*** | (2011.01) |
| ***H01R 24/40*** | (2011.01) |
| ***H01R 13/11*** | (2006.01) |
| *H01R 103/00* | (2006.01) |

(52) U.S. Cl.

CPC ..... *H01R 24/38* (2013.01); *H01R 9/05* (2013.01); *H01R 24/40* (2013.01); *H01R 9/0512* (2013.01); *H01R 13/11* (2013.01); *H01R 2103/00* (2013.01)

USPC ..... 439/578; 439/843

(58) Field of Classification Search

USPC ..... 439/578, 322, 843, 584, 585

See application file for complete search history.

(56) References Cited

U.S. PATENT DOCUMENTS

| | | | | |
|---|---|---|---|---|
| 2,762,025 | A * | 9/1956 | Melcher | 439/580 |
| 3,206,540 | A * | 9/1965 | Cohen | 174/89 |
| 4,106,839 | A * | 8/1978 | Cooper | 439/607.18 |
| 4,248,492 | A * | 2/1981 | Snyder | 439/312 |
| 4,412,717 | A * | 11/1983 | Monroe | 439/582 |
| 4,516,815 | A * | 5/1985 | Venable et al. | 439/95 |
| 5,052,948 | A * | 10/1991 | Hyzin | 439/607.01 |
| 7,189,097 | B2 * | 3/2007 | Benham | 439/352 |
| 7,229,303 | B2 * | 6/2007 | Vermoesen et al. | 439/271 |
| 7,318,609 | B2 * | 1/2008 | Naito et al. | 285/322 |
| 7,587,244 | B2 * | 9/2009 | Olbertz | 607/37 |
| 7,753,705 | B2 | 7/2010 | Montena | |
| 7,828,595 | B2 | 11/2010 | Mathews | |
| 7,892,005 | B2 | 2/2011 | Haube | |
| 7,938,680 | B1 | 5/2011 | Hsieh | |
| 8,062,063 | B2 * | 11/2011 | Malloy et al. | 439/578 |
| 8,506,325 | B2 * | 8/2013 | Malloy et al. | 439/578 |
| 8,753,147 | B2 * | 6/2014 | Montena | 439/578 |
| 8,777,661 | B2 * | 7/2014 | Holland et al. | 439/584 |
| 2008/0102696 | A1 * | 5/2008 | Montena | 439/578 |

(Continued)

FOREIGN PATENT DOCUMENTS

KR 10-0733849 B1 6/2007

*Primary Examiner* — Neil Abrams
*Assistant Examiner* — Travis Chambers
(74) *Attorney, Agent, or Firm* — Paul D. Chancellor; Ocean Law

(57) ABSTRACT

A male coaxial cable connector includes spring with tines and a fastener wherein the spring is housed by the fastener and distal ends of the spring tines are arranged to provide a spring mouth.

10 Claims, 13 Drawing Sheets

(56) References Cited

U.S. PATENT DOCUMENTS

2010/0081321 A1* 4/2010 Malloy et al. ..... 439/578
2010/0297875 A1 11/2010 Purdy et al.
2012/0315788 A1* 12/2012 Montena ..... 439/507
2013/0130543 A1* 5/2013 Holland et al. ..... 439/583

* cited by examiner

SIGNAL CONTINUITY CONNECTOR

PRIORITY CLAIM

This application claims the benefit of U.S. Provisional Patent Application No. 61/569,746 filed Dec. 12, 2011.

BACKGROUND OF THE INVENTION

1. Field of the Invention

The interface between male and female coaxial connectors requires good contact of the outer shield in order to both pass the RF signals with integrity as well as to not allow outside signals to penetrate the cable. This is solved in a variety of ways with RF coaxial connectors. One method used on such connectors as a BNC is to spring-load the grounding components of male and female side. Another method uses threaded male female interfaces requiring precise tightening to set torque levels to insure proper operation. It has been found to maintain the required RF performance that this threaded method requires both a high level of installation craft sensitivity as well as an environment that will not allow loosening over time due to vibration or temperature changes. The F type coaxial connector is used on consumer available applications where it cannot be assured the user will attempt to meet the tightening requirement. There is thus a need for a screw F-Type male connector that will insure electrical continuity despite a loosened male connector nut.

The F-Type male coaxial connectors typically use an inside-threaded front nut to connect a male F-Type connector with a mating outside-threaded female F-Type connector. When tight, the connector maintains a good coaxial cable outer ground/shield connection with the male connector's ferrule tube/post, outer body, and the female F-Type connector shaft. If the male nut is not fully tightened to the female connector, the ground connection between the cable and the connected device may be intermittent. Current methods to remedy this problem of a loose nut is to apply a spring behind the front tube face to spring the F male inner front tube face against the end face of the female. This method has prior art in the BNC and other spring loaded coaxial connectors. This behind-the-front post spring method has a disadvantage if the cable becomes off-axis due to a loose nut since the expected plane-to-plane interface is skewed and may limit conductivity.

2. Description of the Related Art

FIGS. 2-3 show prior art coaxial cable connectors where springs and lock washers are used behind the ferrule-post face to keep the face connected to a female F-Type connector face. FIG. 1 shows a different approach which has a continuity spring forward of the front ferrule face with its contact point facing radially inward against the female body but enclosed in a tube extended from the forward part of the ferrule post. (See U.S. Pat. No. 7,938,680 (the "'680" patent) which is incorporated herein in its entirety and for all purposes).

In the '680 patent, the approach to resolving the electrical continuity problem without the disadvantage of the spring loaded design extends a sleeve attached to the posts' forward end where an inward connection spring is located. This would electrically connect the spring to the tube via contact with the outer sleeve. The disadvantage to this approach is the need for an expensive, very large outer nut to contain the new internal sleeve. In addition, the F connector tightening tools and industry specifications generally require a standard hex nut with an 11 mm hex-hex dimension which is not possible with this inner sleeve design.

SUMMARY OF THE INVENTION

An F-Type male coaxial cable connector includes a tined spring forming a spring mouth for receiving an end of a mating female F-Type connector.

In an embodiment, an F-Type male connector is for terminating a coaxial cable and the connector comprises: an electrically conductive spring having a plurality of tines extending from a spring base; the tines arranged such that they encircle an imaginary axis perpendicular to the spring base and passing through a center of the spring base; the spring engaging a coaxial cable connector ferrule; a mouth of the spring located in an imaginary plane defined by distal tips of the spring tines; and, insertion of a mating connector end into the spring mouth operative to lift the spring tines away from the axis and to provide an electric current path extending from a conductive outer surface of the mating connector to a ferrule engaging ground conductor of the coaxial cable.

In an embodiment, an F-Type male connector is for terminating a coaxial cable and the connector comprises: a coaxial cable connector ferrule having a cable end and a fastener end; an electrically conductive spring having a plurality of tines extending from a spring base; a fastener housing the spring, the spring and the fastener engaging the fastener end of the ferrule; the fastener and spring concentrically arranged about a central axis; a fastener mouth located at a distal end of the fastener and a spring mouth located adjacent to the fastener mouth, the spring mouth encircled by distal tips of the spring tines; and, insertion of a mating connector end into the spring mouth operative to lift the spring tines away from the central axis and to provide an electric current path extending from a conductive outer surface of the mating connector to a ferrule engaging ground conductor of the coaxial cable.

In some embodiments, the electrical continuity problem is solved by providing an inward facing spring mounted within an annular groove in the F-Type male nut. This spring maintains electrical and mechanical contact with the female F-Type outer body, the F-Type nut, and front facing ferrule post tube. The invention provides an F-Type interconnection system and/or method and may be used on the front interconnect section of most F-Type connectors despite its method of attaching the connector to the coaxial cable. The invention provides for RF and DC continuity between the female F-Type body and coaxial cable ground sheath via a conductive spring between said F-Type female body and F-Type male ferrule tube which is connected to the coaxial cable shield.

BRIEF DESCRIPTION OF THE DRAWINGS

The present invention is described with reference to the accompanying figures. These figures, incorporated herein and forming part of the specification, illustrate the present invention and, together with the description, further serve to explain the principles of the invention and to enable a person skilled in the relevant art to make and use the invention.

DETAILED DESCRIPTION OF THE PREFERRED EMBODIMENT

The disclosure provided in the following pages describes examples of some embodiments of the invention. The designs, figures, and descriptions are non-limiting examples of certain embodiments of the invention. For example, other embodiments of the disclosed device may or may not include the features described herein. Moreover, disclosed advantages and benefits may apply to only certain embodiments of the invention and should not be used to limit the disclosed inventions.

In the present invention, a male F-Type connector includes a spring. In various embodiments, the spring has spring tines and in various embodiments the spring provides for a continuous electrical ground circuit between the male connector and a mated female connector.

Figure 1:
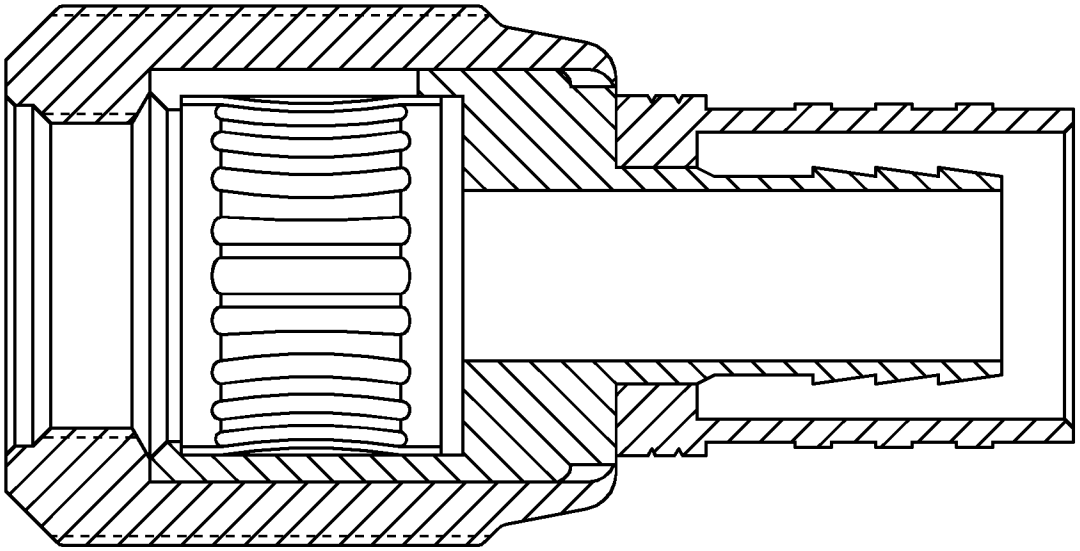
(Prior Art) FIG. 1
FIGS. 1-3 show prior art connectors.
Figure 2:
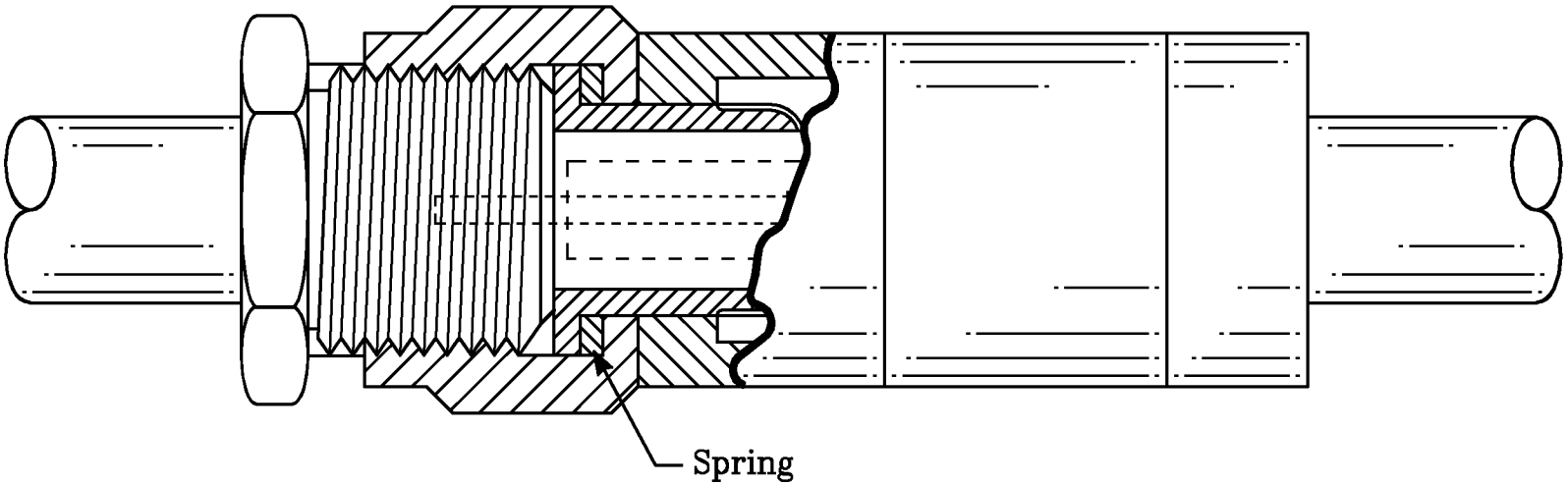
(Prior Art) FIG. 2
Figure 3:
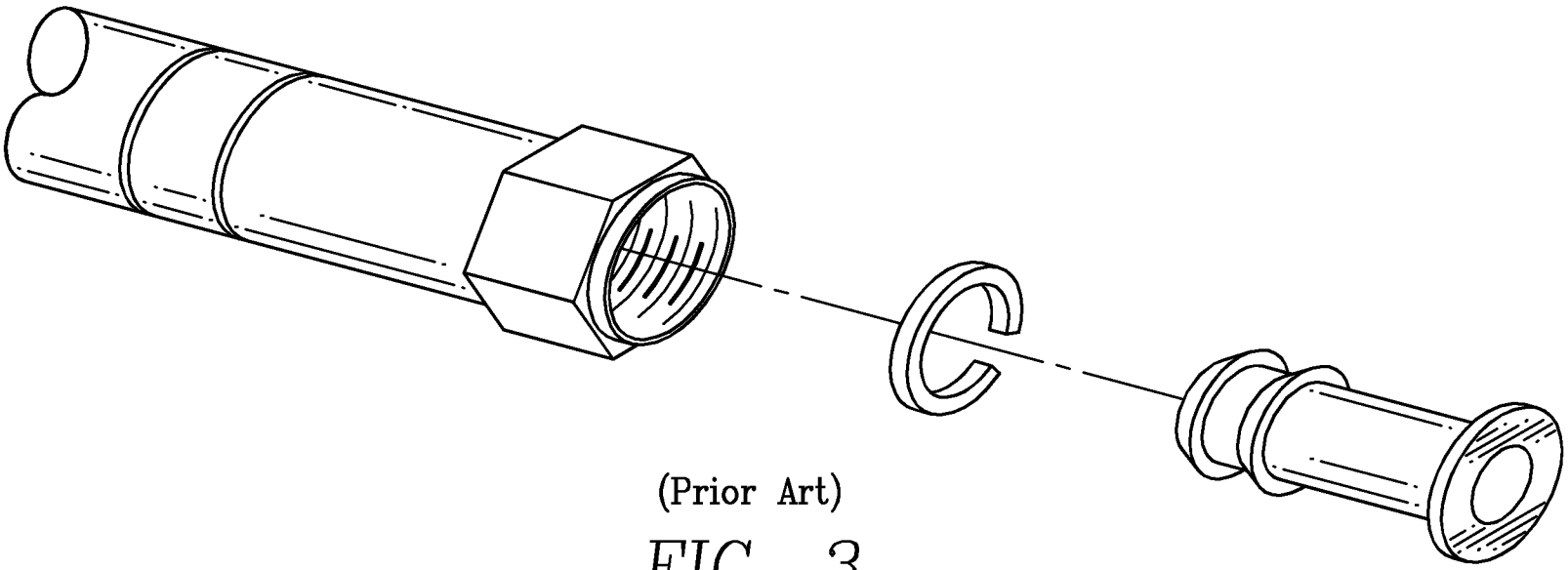
(Prior Art) FIG. 3
Figure 4:
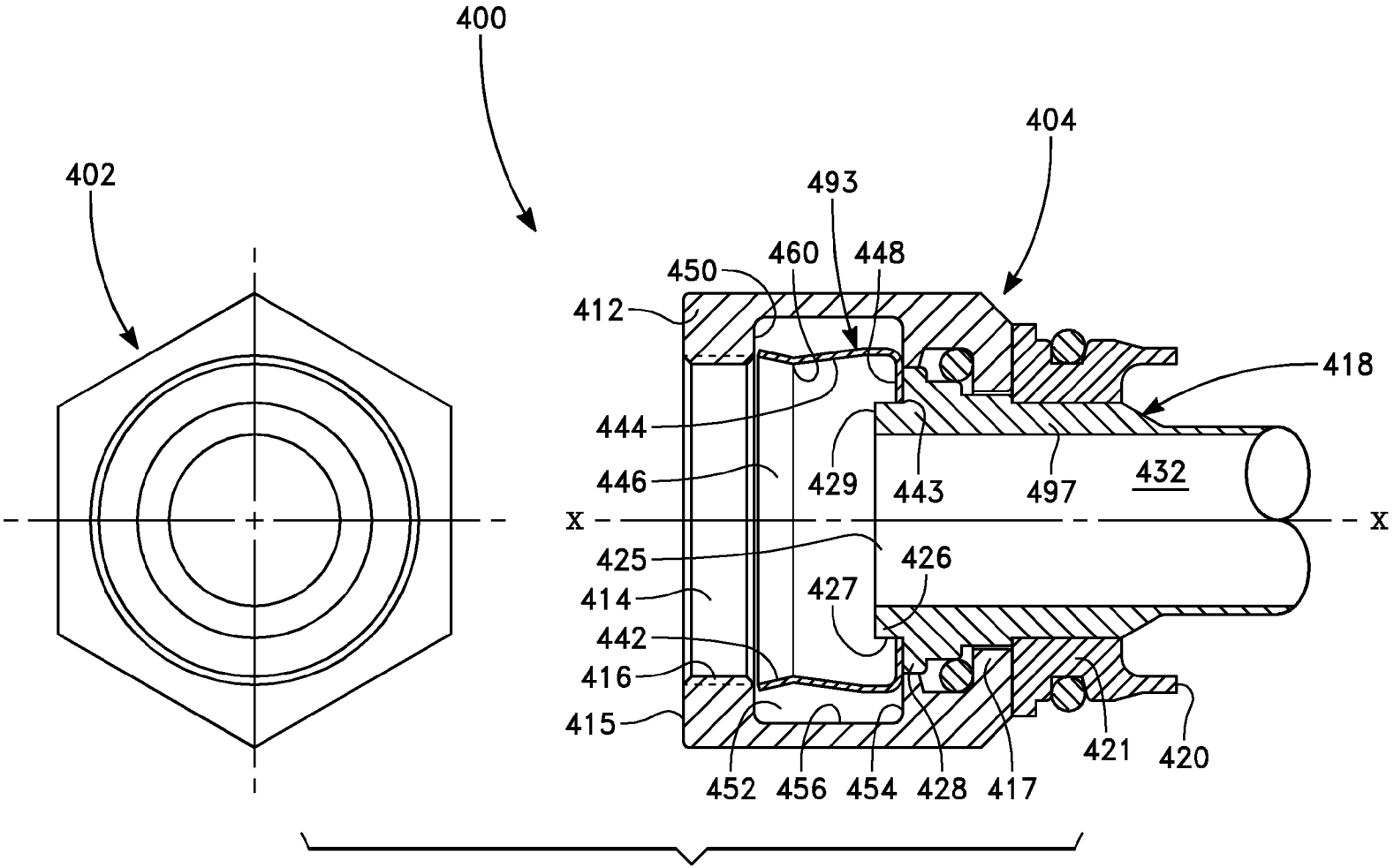
FIG. 4 shows a first embodiment of the present invention.

FIG. 4 shows a male F-Type connector complete with a spring 400. As shown in a connector cross-section 404, a connector centerline x-x extends along a length of the connector and lies in a plane defining the illustrated connector cross-section. And, as shown in an end view 402 taken from a connector mating end 415, a connector fastener mouth 414 provides an entryway for receiving a mating female connector (not shown).

The connector includes a fastener 412 and a connector body 420 that are coupled together by a central, electrically conductive inner ferrule 418 having a ferrule shank 497. A nut annular rim 417 encircles the ferrule and an adjacent body annular rim 421 encircles the ferrule, the nut rotatably engaging the ferrule.

A central passageway of the ferrule 432 extends between a ferrule exit within the fastener 425 and an opposed ferrule entrance (not shown). A ferrule exit end projection 426 has a peripheral surface 427, encircles the ferrule exit, and defines a ferrule exit face 429. Adjoining the ferrule exit end projection is a ferrule shoulder 428.

Within the fastener 412 is a location for placing an electrically conductive spring such as a spring made from a spring steel or another suitable material. In various embodiments, a spring such as a bent tine spring 493 is located in a fastener cavity such as an annular fastener cavity 452 bounded by a radial outer wall 456 and forward and rear sidewalls 450, 454. A spring mouth 446 is for receiving a female F-Type connector threaded end via a nearby fastener mouth 414. In some embodiments, the fastener mouth is threaded 416.

Bent tine spring embodiments include those with tine mouth portions 442 joined at an angle with tine base portions 444 forming an inwardly projecting tine region 460. The tine base joins the tine mouth portion with an annular tine rim 448 defining a circular tine neck 443. Entry of the female threaded end (not shown) into the spring via the spring mouth 446 results in contact with the inwardly projecting tine regions and lifts the tines toward the cavity radial outer wall 456.

As can be seen, the spring neck 443 encircles the ferrule projection 426 and provides a means for locating and/or fixing the spring 493 within the fastener 412. In various embodiments, the spring neck is in intimate contact with the ferrule projection. For example, in some embodiments there is an interference fit between a circular spring neck and an inserted ferrule projection. In some embodiments, there is a weldment conductively interconnecting the spring and the ferrule 418. And, in some embodiments, the spring neck has inwardly directed contacts, such as pointed projections, designed to enhance electrical contact.

Figure 5:
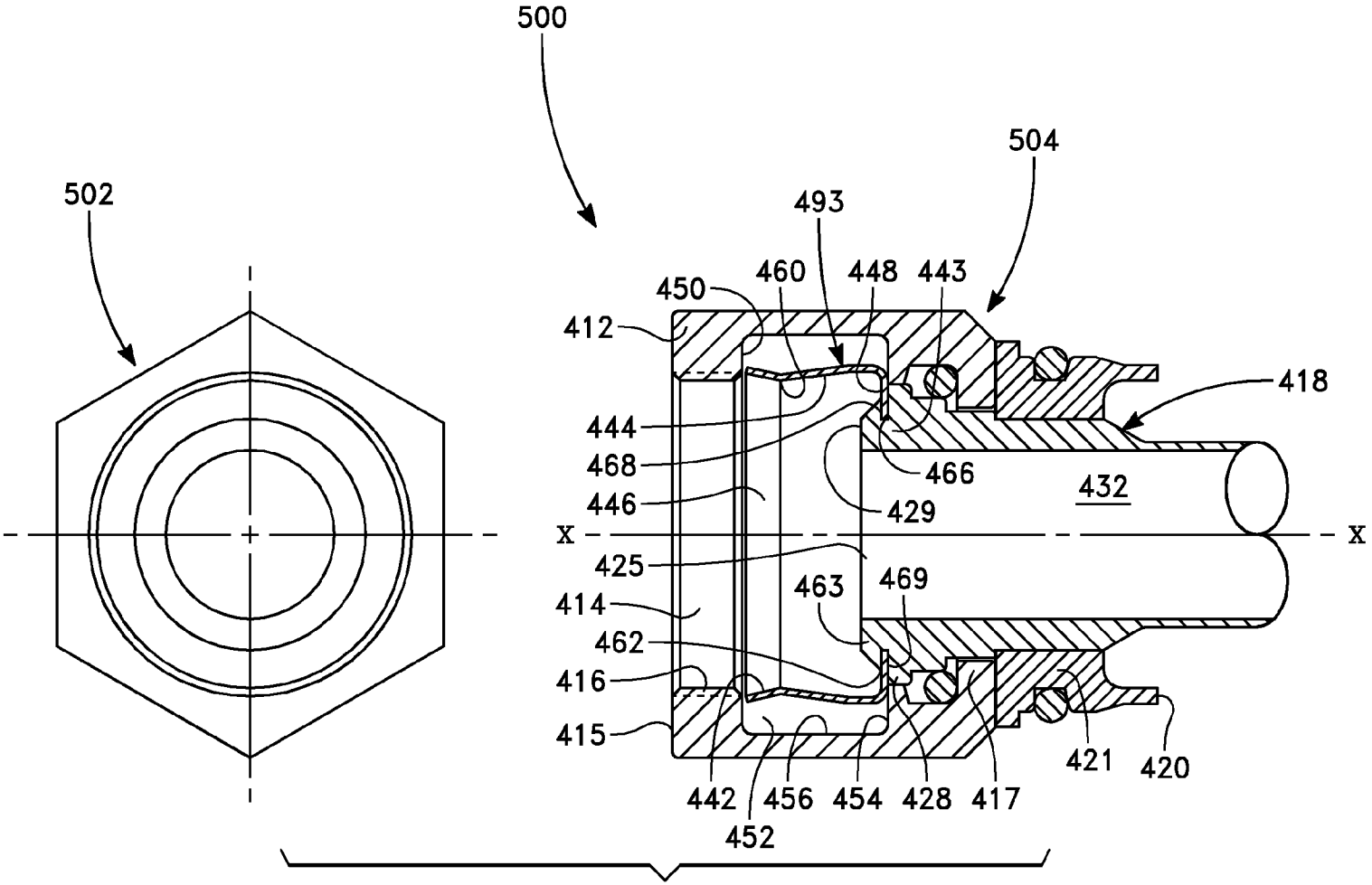
FIG. 5 shows a second embodiment of the present invention.

FIG. 5 shows a male F-Type connector complete with a spring 500. As shown in a connector cross-section 504, a connector centerline x-x extends along a length of the connector and lies in a plane defining the illustrated connector cross-section. And, as shown in an end view 502 taken from a connector mating end 415, a connector fastener mouth 414 provides an entryway for receiving a mating female connector (not shown).

The connector includes a fastener 412 and a connector body 420 that are coupled together by a central, electrically conductive inner ferrule 418. A nut annular rim 417 encircles the ferrule and an adjacent body annular rim 421 encircles the ferrule, and the nut rotatably engages the ferrule.

A central passageway of the ferrule 432 extends between a ferrule exit within the fastener 425 and an opposed ferrule entrance (not shown). A ferrule exit end projection 426 adjoins a ferrule shoulder 428 and has a radial slot 462 encircling the ferrule exit and adjacent to the ferrule shoulder. The ferrule exit end projection has a ferrule exit face 429.

Within the fastener 412 is a location for placing an electrically conductive spring such as a spring made from a spring steel or another suitable material. In various embodiments, a spring such as a bent tine spring 493 is located in a fastener cavity such as an annular fastener cavity 452 bounded by a radial outer wall 456 and forward and rear sidewalls 450, 454. A spring mouth 446 is for receiving a female F-Type connector threaded end via a nearby fastener mouth 414. In some embodiments, the fastener mouth is threaded 416.

Bent tine spring embodiments include a tine mouth portion(s) 442 joined at an angle with tine base portions 444 forming an inwardly projecting tine region 460. The tine base joins the tine mouth portion with an annular tine rim 448 defining a circular tine neck 443. Entry of the female threaded end (not shown) into the spring via the spring mouth 446 results in contact with the inwardly projecting tine regions and lifts the tines toward the cavity radial outer wall 456.

As can be seen, the spring neck 443 encircles the ferrule projection 463 and is captured within the ferrule slot 462. The slot provides a means for locating and/or fixing the spring 493 within the fastener 412. In various embodiments, the spring neck is in intimate contact with a wall(s) of the ferrule slot 466, 468, 469. For example, in some embodiments, there is an interference fit between a circular spring neck and wall(s) of the ferrule slot. In some embodiments, there is a weldment conductively interconnecting the spring and the ferrule 418. And, in some embodiments, the spring neck has inwardly directed contact(s), such as pointed projections (not shown), designed to enhance electrical contact.

There are a number of means for forming the ferrule slot 462. In some embodiments, the ferrule slot is cut in the ferrule. In some embodiments, the ferrule slot is formed by plastic deformation of the ferrule such as plastic deformation of a ferrule projection similar to the ferrule projection 448 of FIG. 4. And in some embodiments, the ferrule slot is formed by other means persons of ordinary skill in the art recognize as suitable.

Figure 6B:
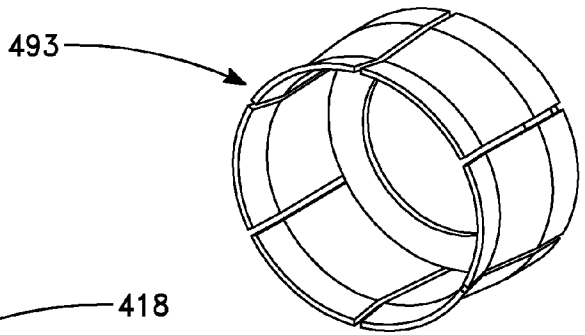
FIGS. 6A-C shows a mated connector and springs.
Figure 6C:
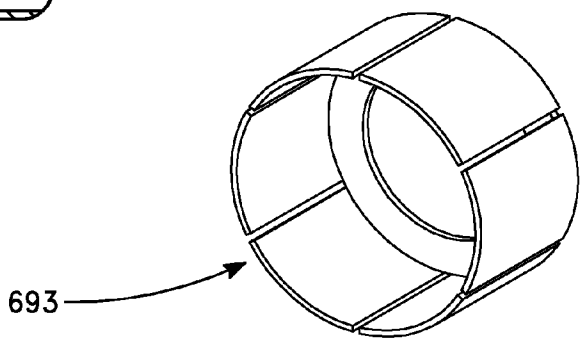
Figure 6A:
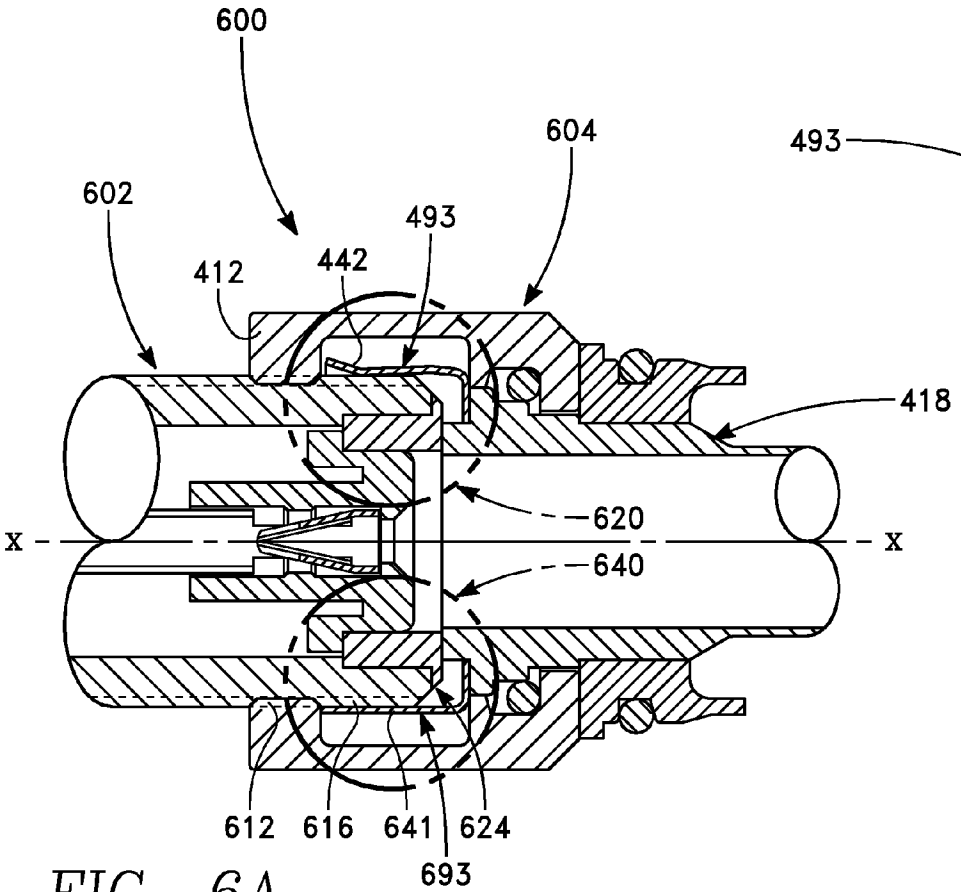

FIGS. 6A-C show a mated connector pair 600 and two springs 493, 693. A male F-Type connector 604 is mated with one end of a female connector such as a splice 602 (as shown). The mated connector pair illustrates operation of the spring in a male F-Type connector like that of FIG. 4. Operation is similar in a male F-Type connector like that of FIG. 5.

In various embodiments, the male F-Type connector 604 has an engaging mouth such as an internally threaded mouth portion 612 for engaging and advancing along an electrically conductive outer surface of a mating conductor such as a splice bearing external metallic threads 616 (as shown).

As seen, the female connector end 624 is inserted in the fastener of the male connector 412. The female connector end is also inserted in the spring 493, 693 having tine portion 442, 641; note details 620, 640 illustrate two different spring designs. Detail 620 illustrates a spring design similar to those of FIGS. 4 and 5 while detail 640 illustrates a different spring design that will be discussed further infra.

Insertion of the female connector end 624 into the spring 493 causes the tines of the spring 442, 444 (see also FIGS. 4 and 5) to be lifted as they press against the female connector end threaded outer surface 616. An electric current path is thereby completed when the electrically conductive spring electrically couples the conductive splice threads with the electrically conductive ferrule 418.

Figure 7:
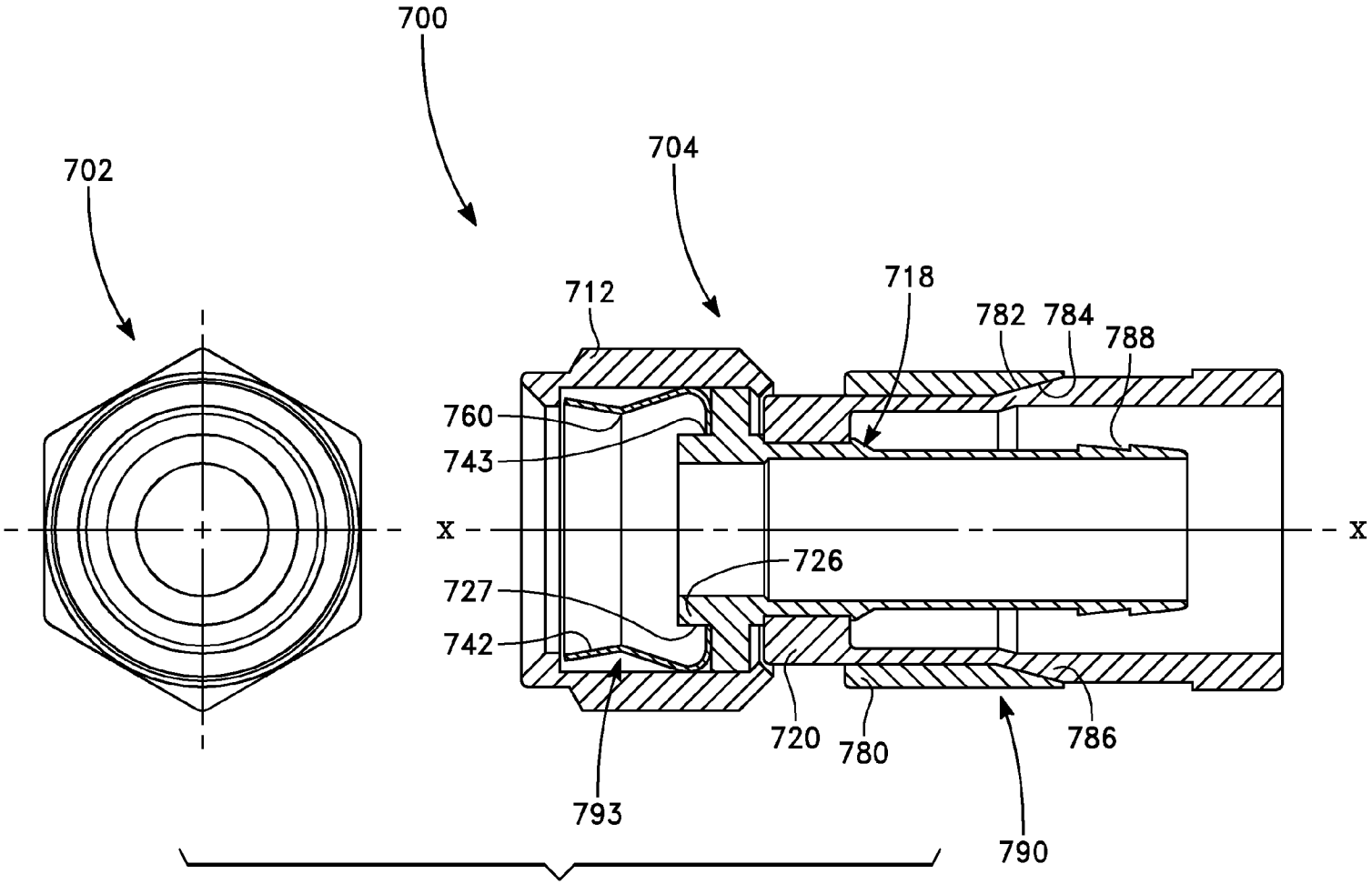
FIG. 7 shows a fourth embodiment of the present invention.

FIG. 7 shows a compression connector including a spring 700. Views of a connector cross-section 704 and a connector fastener end view 702 are provided. Similar to FIGS. 4 and 5, a central ferrule 718 engages a fastener 712 and a connector body 720.

A spring 793 similar to that of FIGS. 4 and 5 is located in a fastener of a male F-Type connector 712. A circular spring neck 743 encircles and/or engages a peripheral ferrule surface 727 of a ferrule end projection 726 for locating and/or fixing the spring in the connector. As described above, an inwardly projecting spring tine region 760 provides for contacting an outer surface of an insertable mating connector end (not shown, see for example FIG. 6).

The compression connector includes a body 720 engaging the ferrule 718. Inserted through a compression barrel 780, the body and barrel have external and internal features respectively such that sliding the barrel toward the ferrule's distal end causes a portion of the body wall 786 to be pushed in toward the ferrule and in some embodiments to be pushed in toward surface features such as ferrule barbs 788. In an embodiment, the barrel has an internal chamfer 784 for smoothly engaging and compressing a diametrically enlarged body section 790 via an external ramp on the body 782.

Figure 8:
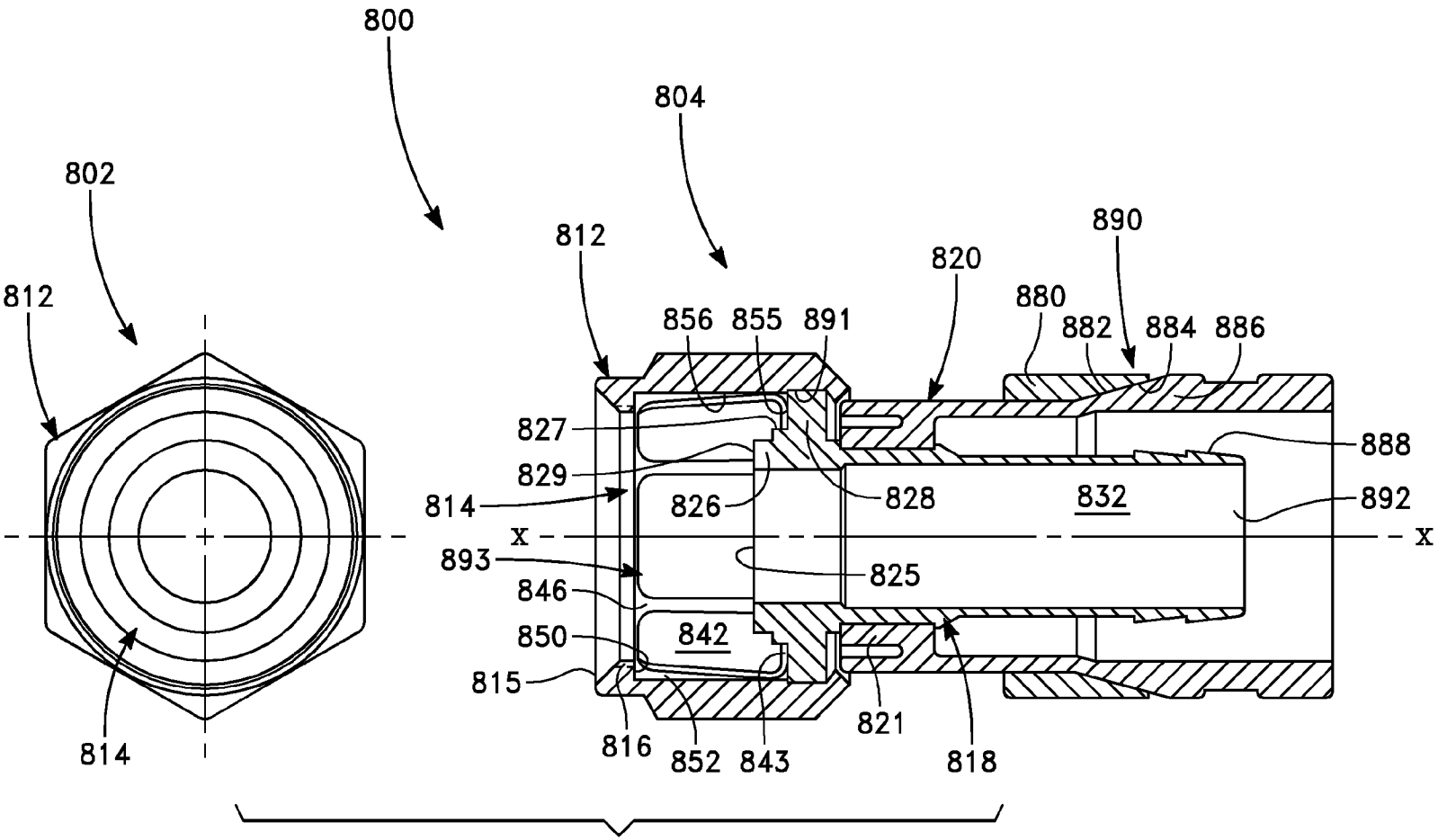
FIG. 8 shows a fifth embodiment of the present invention.

FIG. 8 shows a second compression connector with a spring 800. As shown in a connector partial cross-section 804, a connector centerline x-x extends along a length of the connector and lies in a plane defining the illustrated connector cross-section. And, as shown in an end view 802 taken from a connector mating end 815, a connector fastener mouth 814 provides an entryway for receiving a mating female connector (see similar spring engaging mating female connector in detail 640 of FIG. 6).

The connector includes a fastener 812 and a connector body 820 that are coupled together by a central, electrically conductive inner ferrule 818. A nut annular inner groove 891 receives a ferrule shoulder 828 and an adjacent body annular rim 821 encircles the ferrule, the nut rotatably engaging the ferrule.

A central passageway of the ferrule 832 extends between a ferrule exit within the fastener 825 and an opposed ferrule entrance 893. A ferrule exit end projection 826 has a peripheral surface 827, encircles the ferrule exit, and defines a ferrule exit face 829. Adjoining the ferrule exit end projection is the ferrule shoulder 828.

Partially bounded by the fastener 812 is a location for placing an electrically conductive spring such as a spring made from a spring steel or another suitable material. In various embodiments, a spring such as a bent tine spring 893 is located in a fastener cavity such as a substantially annular fastener cavity 852 bounded by a radial outer fastener wall 856 and a forward fastener wall 850 and a rear surface of the ferrule shoulder 855. A spring mouth 846 is for receiving a female F-Type connector threaded end via a nearby fastener mouth 814. In some embodiments, the fastener mouth is threaded 816.

Straight tine spring embodiments include substantially straight tine segments 842 joined with a circular spring neck 843. Entry of the female threaded end (see detail 640 of FIG. 6 for female connector mated with similar spring) into the spring via the spring mouth 846 results in contact with the spring tines 842 and lifts the tines toward the cavity radial outer wall 856.

As can be seen, the spring neck 843 encircles the ferrule projection 826 and provides a means for locating and/or fixing the spring 893 within the fastener 812. In various embodiments, the spring neck is in intimate contact with the ferrule projection. For example, in some embodiments there is an interference fit between a circular spring neck and an inserted ferrule projection. In some embodiments, there is a weldment conductively interconnecting the spring and the ferrule 818. And, in some embodiments, the spring neck has inwardly directed contacts, such as pointed projections, designed to enhance electrical contact.

In various embodiments, the connector body includes one or more of: an external ramp 882, a barrel internal chamfer 884 for smoothly engaging and compressing a diametrically enlarged body section 890. And, in various embodiments, a portion of the body wall 886 is pushed in toward the ferrule. In some embodiments the body wall is pushed toward surface features such as ferrule barbs 888.

In an embodiment, the barrel has an internal chamfer 884 for smoothly engaging and compressing a diametrically enlarged body section 890 via an external ramp on the body 882.

Figure 9A:
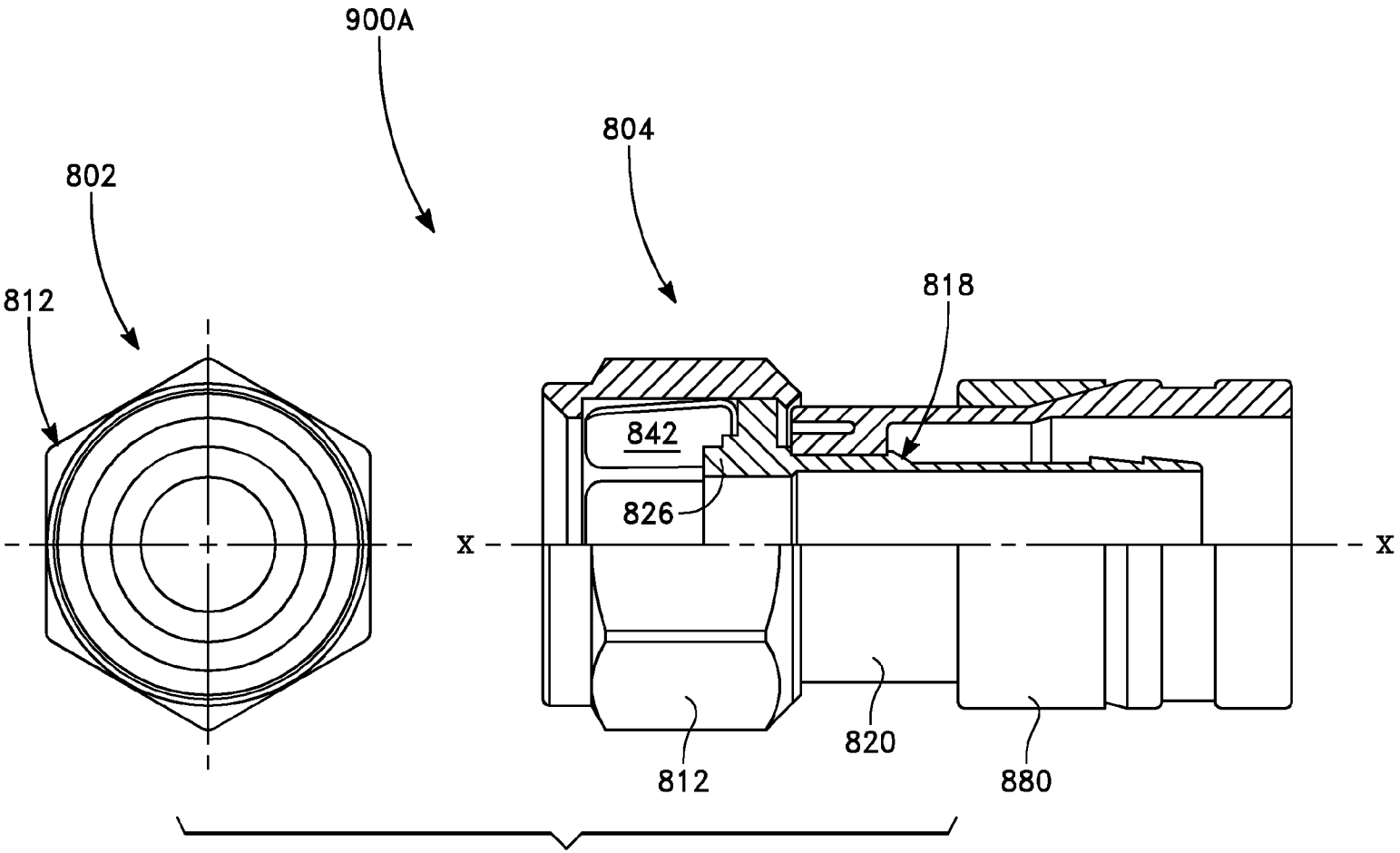
FIGS. 9A, B show assemblies of the connector of FIG. 8.
Figure 9B:
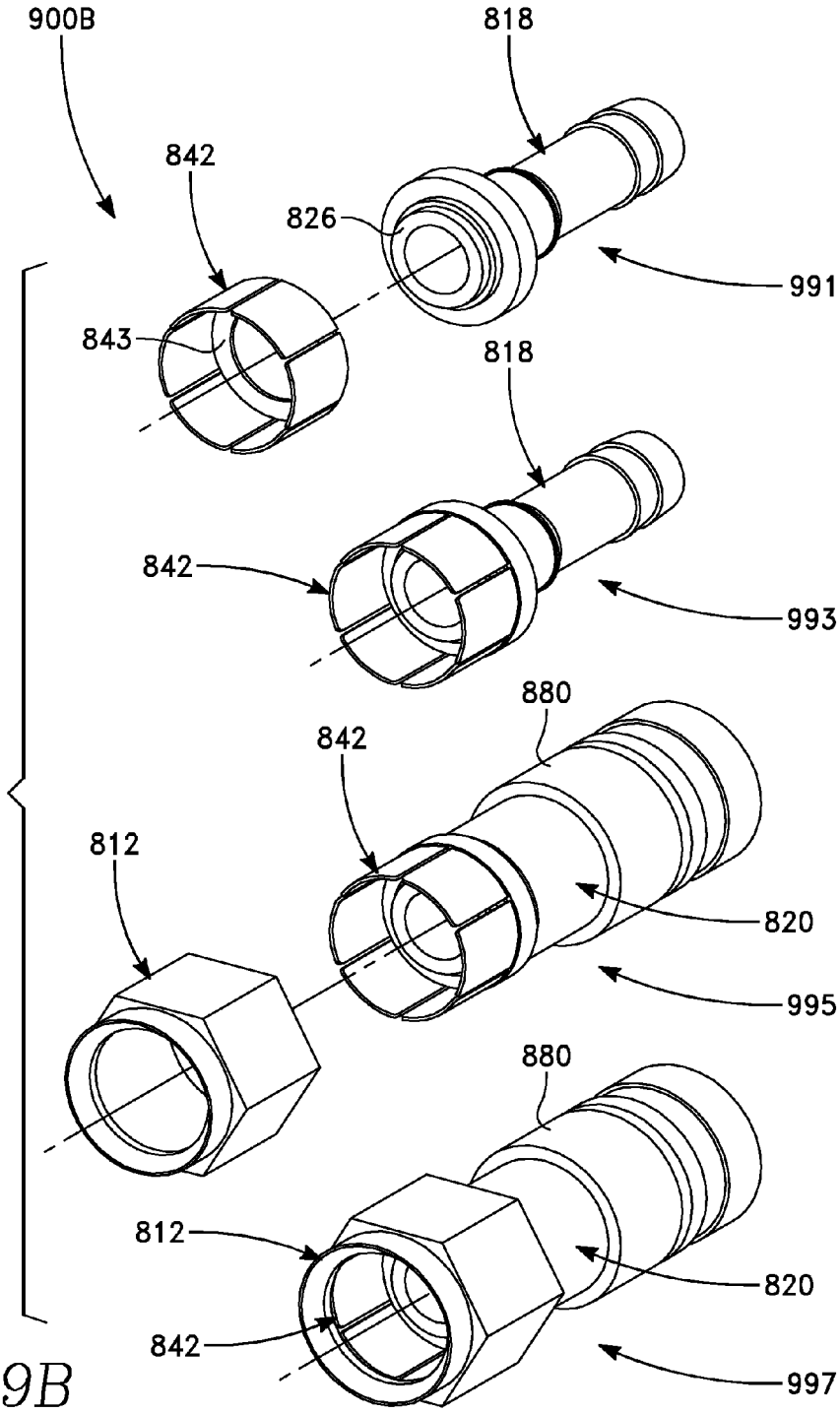

FIGS. 9A and 9B show various assemblies and partial assemblies of a compression connector with a spring 900A, 900B. FIG. 9A shows a fully assembled compression connector 802, 804 with a spring 893. FIG. 9B shows partial assemblies.

A first partial assembly 991 shows a ferrule 818 with a ferrule exit end projection 826 prior to fitment of a spring 893 via engagement of a spring neck 843 with the ferrule exit end projection 826.

Similarly, a second partial assembly 993 shows the ferrule 818 with the spring 893 engaged with the ferrule exit end projection 826.

Similarly, a third partial assembly 995 shows the ferrule 818 with the spring 893 engaged with the ferrule exit end projection 826, the body 820 engaged with the ferrule, and the barrel 880 engaging the body.

And, a fourth partial assembly 997 shows the fastener 812 engaging the ferrule 818, the spring 893 engaged with the ferrule exit end projection 826, the body 820 engaged with the ferrule, and the barrel 880 engaging the body.

Figure 10:
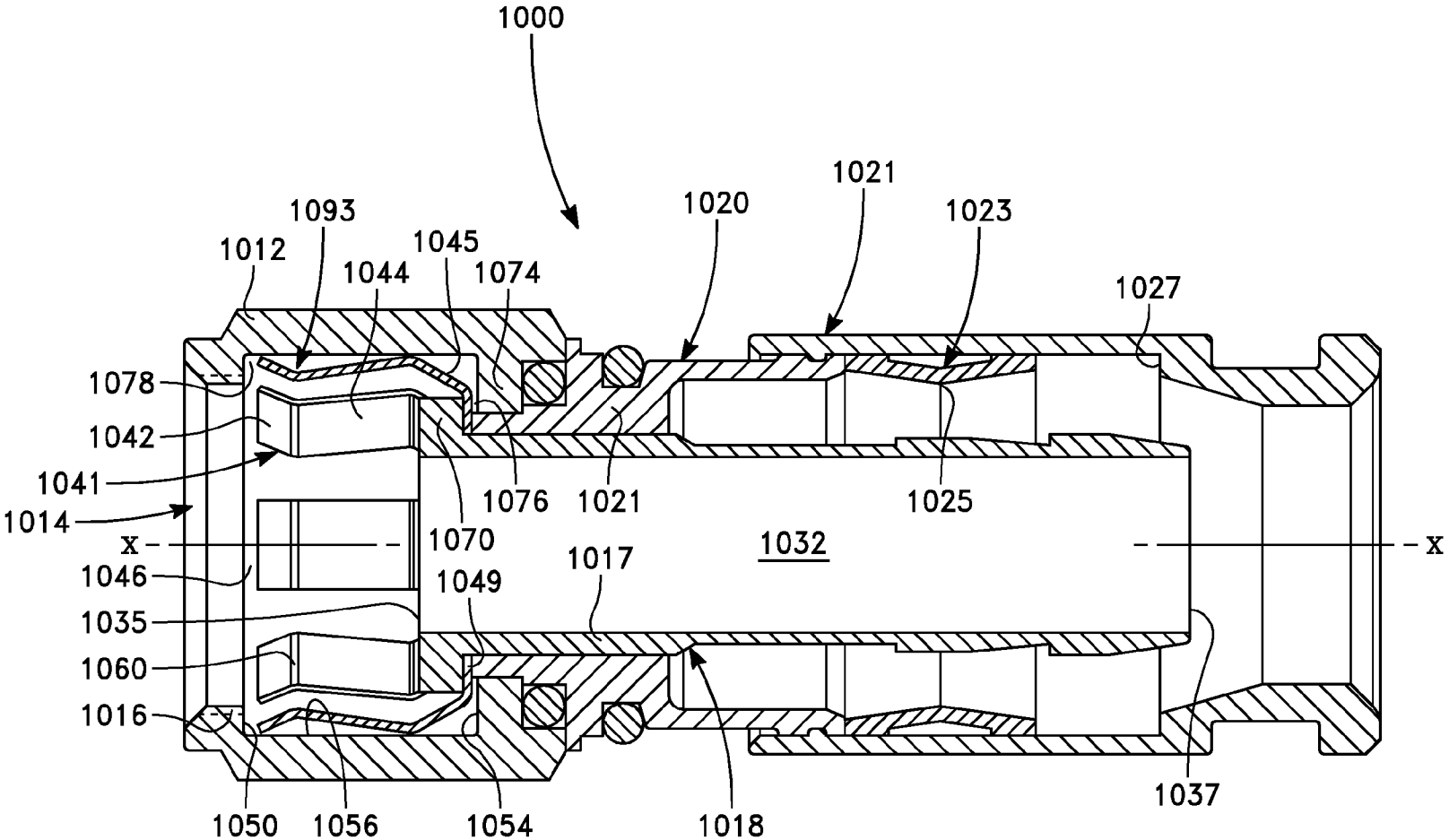
FIG. 10 shows a sixth embodiment of the present invention.

FIG. 10 shows a third compression connector with a spring 1000. Presented as a partial cross-section, a connector centerline x-x that extends along a length of the connector. A connector fastener mouth 1014 provides an entryway for receiving a mating female connector (not shown).

The connector includes a fastener 1012 and a connector body 1020 with a trailing deformable ring 1023. An outer shell 1021 encircles the body and is for advancing along the body such that a concave inflection point of the ring 1025 is pushed toward the connector centerline x-x by action of an internal body shoulder 1027. Ring deformation serves to pinch an outer jacket and grounding sheath of a coaxial cable (not shown for clarity) located between a ferrule 1018 having a ferrule shank 1017 and portions of the deformed ring. A ferrule bore 1032 is for receiving coaxial cable central conductor and surrounding dielectric.

The connector fastener 1012 and connector body 1020 are coupled together by the centrally located, electrically conductive ferrule 1018. A nut inwardly facing annular rim 1074 encircles the ferrule behind a ferrule end flange 1070 and an adjacent body annular rim 1021 encircles the ferrule. The fastener rotatably engages the ferrule. The central passageway of the ferrule 1032 extends between a ferrule exit within the fastener 1035 and an opposed ferrule entrance 1037.

Within the fastener 1012 is a location for placing an electrically conductive spring. In various embodiments, such portion of the fastener is not threaded. Spring materials of construction include electrically conductive materials, for example spring steel or another suitable material.

In various embodiments, a spring such as a bent tine spring 1093 is located in a fastener cavity such as an annular fastener cavity 1078 bounded by a radial outer wall 1056 and forward and rear sidewalls 1050, 1054. A spring mouth 1046 is for receiving a female F-Type connector threaded end via a nearby fastener mouth 1014. In some embodiments, the fastener mouth or a portion of the fastener mouth, or a nearby surface is threaded 1016.

In the embodiment shown, a spring 1093 having bent tines 1041 is used. Bent tine spring embodiments include those with tine mouth portions 1042 joined at an angle with tine intermediate portions 1044 forming a region projecting inwardly toward the connector centerline x-x 1060. The tine intermediate portion interconnects the tine mouth and a tine transition region 1045. The tine transition region is located between the tine intermediate region and a tine or spring base 1049.

As can be seen, the spring base 1049 is in the form of an annular rim that is radially inwardly directed. The base surrounds the ferrule 1018 and is located at least partially in a gap 1076 between the ferrule flange 1070 and the fastener rim 1074. In various embodiments, the spring base provides electrical contact by one or more of mechanical interference and conductive junctions. For example, electrical contact via one or more of an interference fit between the base and the ferrule and a conductive junction such as a weldment between the base and the ferrule. Together with the fastener cavity 1078, the spring base fixture positions and captures the spring within the fastener.

In various embodiments, the spring 1093 aids in providing connector electrical continuity. For example, entry of a female threaded end (not shown) into the spring via the spring mouth 1046 results in contact with the inwardly projecting tine regions 1060 and lifts the tines 1041 toward the cavity radial outer wall 1056.

Figure 11A:
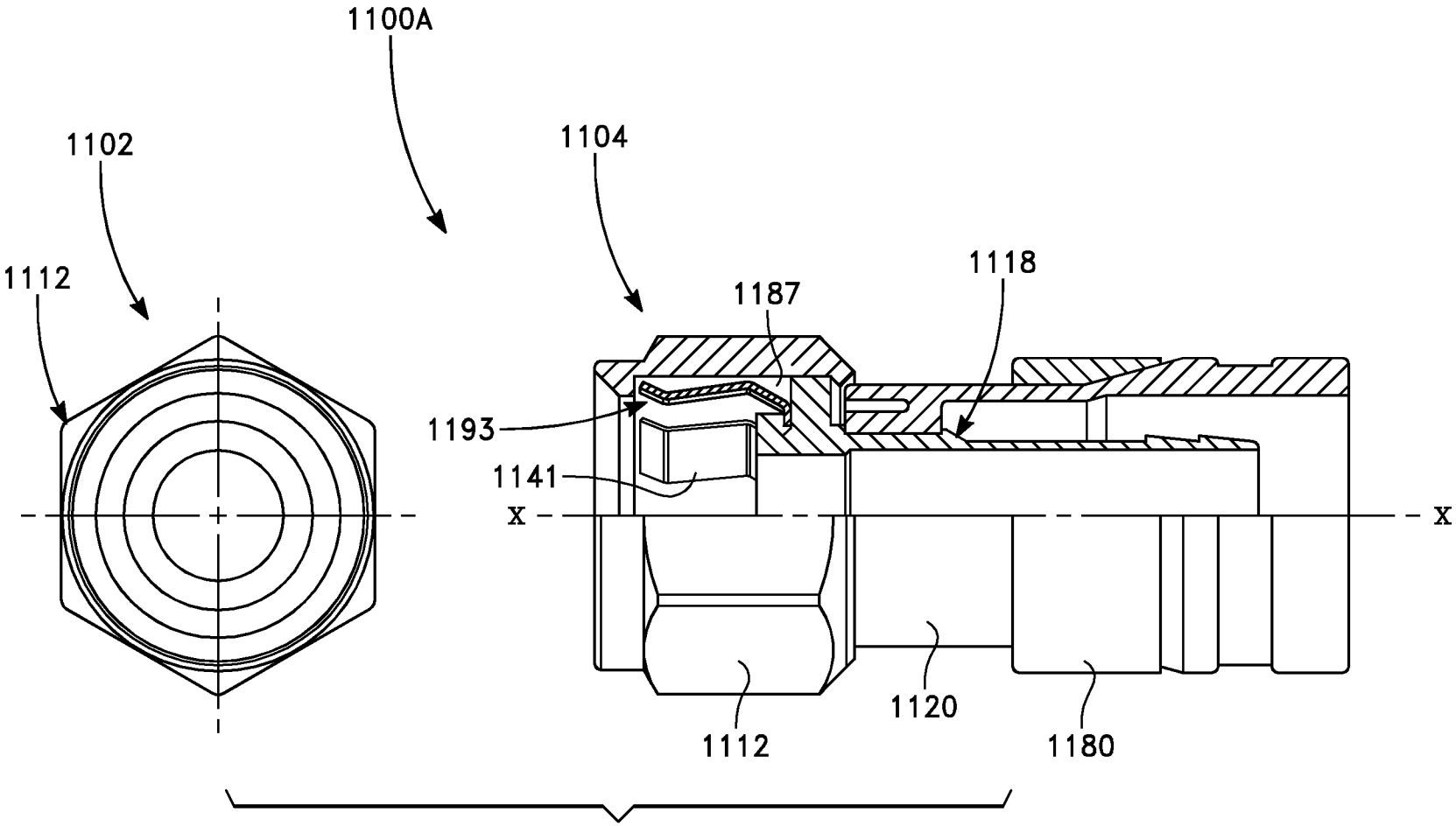
FIGS. 11A, B show a seventh embodiment of the present invention.
Figure 11B:
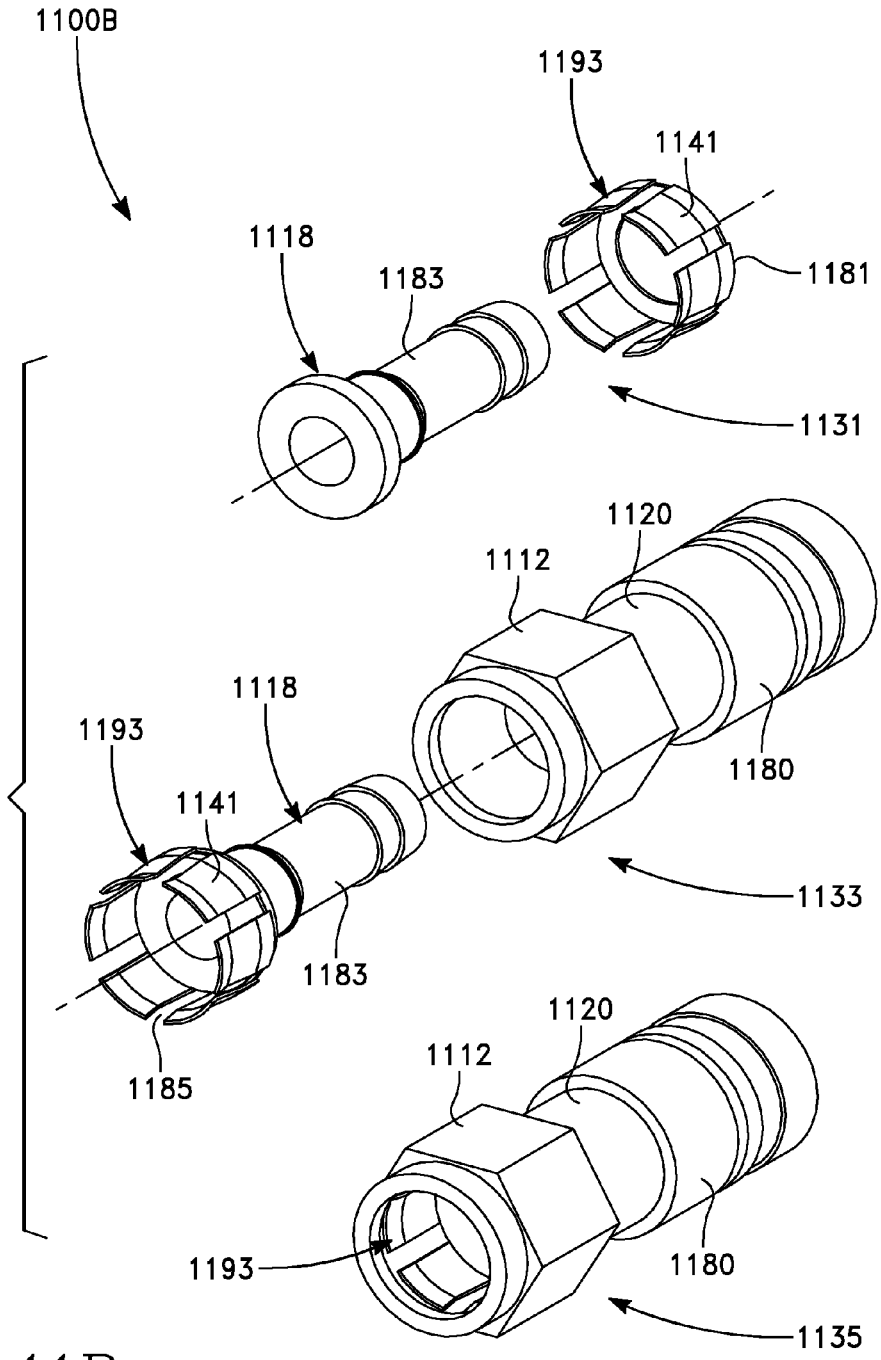

FIGS. 11A and 11B show various assemblies and partial assemblies of a compression connector with a spring 1100A, 1100B. A fully assembled compression connector 1102, 1104 includes a spring 1193 and tines 1141. Passing through the fastener and the connector body 1120 is a ferrule 1118 and slidingly engaged over the body is a compression member 1180.

A first partial assembly 1131 shows a ferrule 1118 and ferrule shank 1183 prior to fitment of a spring 1193.

Similarly, a second partial assembly 1133 shows the ferrule shank 1183 engaging the spring 1193 such that the shank passes through a hole in the spring base 1181 and a spring mouth 1185 encircles the connector central axis x-x.

And similarly, a third partial assembly 1135 shows an assembled connector with the spring 1193 located in a space of the fastener interior 1187. As shown, the ferrule shank passes at least partially through the fastener 1112 and into the body 1120.

In operation, a connector 404, 504, 604, 704, 804, 1000, 1000A includes a fastener 412, 712, 812, 1012, 1112 and a spring 493, 693, 793, 893, 1093, 1193 located within the fastener engages a mating female connector (see e.g. FIG. 6) that is inserted in the fastener. Electrically conductive parts including the spring and the ferrule provide an electrical circuit connecting a conductive surface of the mating female conductor to a ground conductor of a coaxial cable (not shown) that encircles and engages the ferrule 418, 718, 818, 1018, 1118.

U.S. Pat. No. 6,217,383 filed Jun. 21, 2000 is incorporated herein in its entirety and for all purposes including its description of coaxial cables, ferrules or posts, connector assemblies, and the like.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. An F-Type male connector for terminating a coaxial cable the connector comprising:

an electrically conductive spring having a plurality of tines extending from a spring base;

the tines arranged such that they encircle an imaginary axis perpendicular to the spring base and passing through a center of the spring base;

the spring engaging a coaxial cable connector ferrule having an exit end near the spring and an opposed entry end;

a mouth of the spring located in an imaginary plane defined by distal tips of the spring tines; and, insertion of a mating connector end into the spring mouth operative to lift the spring tines away from the axis and to provide an electric current path extending from a conductive outer surface of the mating connector to a ferrule engaging ground conductor of the coaxial cable.

2. The connector of claim 1 further comprising:

a ferrule exit end projection; and, wherein the spring base engages the ferrule exit end projection.

3. The connector of claim 1 further including:

a ferrule flange; and, wherein the spring base encircles a ferrule shank between the ferrule flange and the ferrule entry end.

4. The connector of claim 1 further including:

a ferrule flange; and, wherein the spring base encircles a ferrule shank between the ferrule flange and a fastener inwardly directed rim.

5. An F-Type male connector for terminating a coaxial cable the connector comprising:

a coaxial cable connector ferrule having a cable end and a fastener end;

an electrically conductive spring having a plurality of tines extending from a spring base;

a fastener housing the spring;

the spring and the fastener engaging the fastener end of the ferrule;

the fastener and spring concentrically arranged about a central axis;

a fastener mouth located at a distal end of the fastener and a spring mouth located adjacent to the fastener mouth, the spring mouth encircled by distal tips of the spring tines; and, insertion of a mating connector end into the spring mouth operative to lift the spring tines away from the central axis and to provide an electric current path extending from a conductive outer surface of the mating connector to a ferrule engaging ground conductor of the coaxial cable.

6. The connector of claim 5 further comprising:

a ferrule fastener end projection; and, wherein the spring base engages the ferrule fastener end projection.

7. The connector of claim 5 further including:

a ferrule flange; and, wherein the spring base encircles a ferrule shank between the ferrule flange and the ferrule cable end.

8. The connector of claim 5 further including:

a ferrule flange; and, wherein the spring base encircles a ferrule shank between the ferrule flange and a fastener inwardly directed rim.

9. An F-Type male connector for terminating a coaxial cable the connector comprising:

a coaxial cable connector ferrule having a cable end and a fastener end;

an electrically conductive spring having a plurality of tines extending from a spring base;

a tubular fastener having internal threads adjacent to a first fastener end and no internal threads adjacent to an opposed second fastener end;

the unthreaded portion of the fastener housing the spring;

the spring and the fastener engaging the fastener end of the ferrule;

the fastener and spring concentrically arranged about a central axis;

a fastener mouth located at a distal end of the fastener and a spring mouth located adjacent to the fastener mouth, the spring mouth encircled by distal tips of the spring tines; and, insertion of a mating connector end into the spring mouth operative to lift the spring tines away from the central axis and to provide an electric current path extending from a conductive outer surface of the mating connector to a ferrule engaging ground conductor of the coaxial cable.

10. The connector of claim 9 further comprising:

a compression barrel encircling the connector and located between first and second opposed ends of the connector; and, movement of the compression barrel toward the first end of the connector operative to fix a coaxial cable inserted in the first end of the connector to the connector.

* * * * *